US006305635B1

(12) United States Patent
Looser

(10) Patent No.: US 6,305,635 B1
(45) Date of Patent: Oct. 23, 2001

(54) CONTINUOUS WEB WINDING METHOD AND DEVICE WITH SUCTION-INDUCED WINDING START OF EMPTY CORE MANDRELS

(75) Inventor: Gottlieb Looser, Balzers (LI)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 09/463,602

(22) PCT Filed: May 25, 1998

(86) PCT No.: PCT/EP98/03067

§ 371 Date: Jan. 28, 2000

§ 102(e) Date: Jan. 28, 2000

(87) PCT Pub. No.: WO99/06313

PCT Pub. Date: Feb. 11, 1999

(30) Foreign Application Priority Data

Jul. 30, 1997 (CH) ..... 1824/97

(51) Int. Cl.[7] ..... B65H 35/04
(52) U.S. Cl. ..... 242/527.3; 242/532.2
(58) Field of Search ..... 242/532.2, 548.4, 242/532.7, 533.5, 535.1, 527.3

(56) References Cited

U.S. PATENT DOCUMENTS

| | | | | |
|---|---|---|---|---|
| 3,539,125 | * | 11/1970 | Patriksson | 242/527.4 |
| 3,642,221 | * | 2/1972 | Hellemans | 242/527.4 |
| 3,908,924 | * | 9/1975 | Schulze | 242/527.3 |
| 4,146,187 | * | 3/1979 | Steiner | 242/527.4 |
| 4,191,341 | | 3/1980 | Looser . | |
| 4,196,865 | * | 4/1980 | Patriksson | 242/521 |
| 4,327,877 | * | 5/1982 | Perini | 242/527.3 |
| 4,693,157 | | 9/1987 | Looser . | |
| 4,770,358 | * | 9/1988 | Suzuki et al. | 242/527.3 |
| 4,798,351 | * | 1/1989 | Halter et al. | 242/532.2 |
| 4,852,820 | | 8/1989 | Looser . | |
| 5,257,748 | * | 11/1993 | Morizzo | 242/527 |
| 5,275,348 | | 1/1994 | Looser . | |
| 5,865,389 | * | 2/1999 | Gonzales | 242/358 |
| 6,029,927 | * | 2/2000 | Wohlfahrt et al. | 242/527.2 |
| 6,098,916 | * | 8/2000 | Matteucci et al. | 242/527.3 |
| 6,186,436 | * | 2/2001 | Selle et al. | 242/532.2 |

FOREIGN PATENT DOCUMENTS

| | | | | |
|---|---|---|---|---|
| 1574426 | * | 1/1972 | (DE) | B65H/19/22 |
| 2705776 | * | 8/1978 | (DE) | B65H/19/22 |
| 19542096 A1 | * | 10/1996 | (DE) | B65H/19/28 |
| 89595 | * | 9/1983 | (EP) | B65H/19/22 |

* cited by examiner

*Primary Examiner*—Donald P. Walsh
*Assistant Examiner*—Daniel K Schlak
(74) *Attorney, Agent, or Firm*—Blank Rome Comisky & McCauley LLP

(57) ABSTRACT

A method is disclosed for winding a continuous web of material on a core mandrel, the winder comprising a cutter that actuates to provide a new end of web material. The cutter itself comprises a source of vacuum for creating an airflow around a new core mandrel between the mandrel and a guide wall which extends around at least one fourth of the mandrel surface, the airflow causing the new web end to follow the mandrel around and tuck said new end between the mandrel circumference and the tensioned web extending between the new mandrel and upstream equipment.

24 Claims, 2 Drawing Sheets

25

28
20
206
205
B
L
203
200
209
204
$E_0$
201
263
27
213
$E_1$
K
210
211
26
212
261
21

35

38
30
306
305
B
L
39
300
321
322
304
$E_0$
301
303
309
$E_1$
37
313
310
K
311
36
312
361
31

CONTINUOUS WEB WINDING METHOD AND DEVICE WITH SUCTION-INDUCED WINDING START OF EMPTY CORE MANDRELS

FIELD OF THE INVENTION

The invention relates to a method for winding a continuous web of material onto a series of core mandrels, to a device for cutting the web on changing the core mandrels, to a web winding device and to the application of the method.

BACKGROUND OF THE INVENTION

Web winders and web winding methods are known in various embodiment forms and are e.g. described in DE-A 2 243 504, EP-A-0 017 277, EP-A-0 394 197 and CH-A-683 992 and the state of the art is described in these documents. Common to the known winders is that a relatively quick running and more or less endless material web of plastic foil, paper textile material or another relatively thin (typically 10 to 1000 $\mu$m thick) and flexible material with working widths of up to a few meters either in the course of the manufacture of the web material or with its processing must be continuously wound, i.e. without interruption of the flow of material, onto a series of core mandrels which are fed to the winder from a winding reel magazine.

With this there are in particular two problems to be solved, specifically on the one hand a very rapid, clean and precise separation or cutting procedure is to be effected and on the other hand the front end of a new web section is to be brought into winding contact with a fresh, i.e. empty core mandrel. An approximately right-angled cutting procedure with high web running speeds may only be achieved with a knife acting suddenly, e.g. within 0.1–0.5 seconds, over the whole web width, which with web winders for the production or processing of typical technical plastic foils is mostly a serrated knife, as is described in CH-A-674 352. According to the transverse cutting method described in the above mentioned patent document DE-A-2 243 504 a knife or blade with a relatively high speed is guided transversely over the material web, which leads to an oblique cut.

For achieving the winding contact for the winding of a core mandrel which is still empty usually adhesives or adhesive tapes are used. This in practice has various disadvantages such as the lessening of the effectiveness of the adhesive layers by dust, the unwanted contamination of adhesive or adhesive tape into the winding and the use of organic solvents. Suggestions for achieving the winding contact by way of electrostatics, such as e.g. in EP-A- 0 270 498 and the state of the art described therein have not been able to be sustained in practice up to now on account of the required high voltages and the consequences of a change in air humidity.

A common disadvantage of the known methods and devices is a more or less heavy jerk with the winding procedure which may lead to disadvantageous effects on premounted, i.e. on the upstream side manufacturing, processing or refining units.

BRIEF SUMMARY OF THE INVENTION

It is the object of the invention to offer a winding method which does not have the mentioned disadvantages or only to a negligible extent. The object of the invention is also an improved cutting device and a new web winder.

These objects are according to the invention achieved by a method for winding a continuous web of material onto a series of core mandrels of a winding device which has a winding roller, at least one movable deflection roller and a cutting device, characterised in that the front end of the web formed on actuation of the cutting device, under the effect of an arc-shaped airstream which extends around at least roughly a quarter of the spool circumference, at least approximately over the width of the core mandrel and up to the vicinity of the contact line between the winding roller and the bearing core mandrel, is brought into winding contact with the core mandrel.

The description "winding contact" used here means a contact between the core mandrel and the new front web end formed by cutting the web, which is sufficient for winding a fresh core mandrel.

The speed of the airflow is preferably twice in particular three times and e.g. six times greater than the material web running continuously with web running speeds of 30 to 400 meters/minute or more.

Preferably every winding roller, thus that of the preceding finished winding as well as that of the fresh subsequent winding is connected to a central drive which may be controlled such that the tensile stress acting on the web may be kept to a desired value and is not dependent on the thickness of the respective winding. In a useful manner for this a drive acting from the left side and one from acting the right side of the winder is used.

Preferably the arc-shaped airstream is produced by a reduced pressure, e.g. from −450 to −900 millibar, acting in the vicinity of the contact line between the winding roller and the core mandrel bearing on this. According to a preferred embodiment form of the method the formation of the arc-shaped airstream is supported by lateral afflux streams which are produced by the pressure difference between the applied reduced pressure and the surrounding pressure, or a hyperbaric pressure from an excess pressure source.

Generally it is preferred that the web on actuation of the cutting means contacts the core mandrel over roughly half its circumference.

In order to make the cutting procedure practically jerk-free, it is useful to keep the web path, with the help of a reduced pressure applied in the inside of the winding roller, on the winding roller provided with openings of the roller casing. For improving the contact of the web with the core mandrel in the inside of the core mandrel provided with openings there is applied a reduced pressure.

The cutting device according to the invention, for a device for winding a continuous web of material onto a series of core mandrels is characterised in that the cutting device has a reduced pressure channel which extends practically over the length of the core mandrels and which is connected to a guiding wall encompassing in an arc-shaped manner the core mandrel about at least a quarter of its circumference and to a serrated knife, in order to bring the front end of the web, which is formed on actuation of the cutting means, under the effect of an arc-shaped airstream extending at least around a quarter of the spool circumference at least approximately over the width of the core mandrel and up to the vicinity of the contact line between the winding roller and the bearing core mandrel, into winding contact with the core mandrel. Preferably the cutting means is connected to a means for pivoting the knife into the path of the web between a fresh core mandrel bearing on the winding roller and a movable winding roller which is brought into a position near to the core mandrel.

The device, according to the invention, for winding a continuous web of material onto a series of core mandrels includes a winding roller, at least one movable deflecting roller and a means for severing the web in order on this to form a web end thereon passing onto a preceding full core mandrel and a web end envisaged for winding on the subsequent empty core mandrel, and is characterised in that the cutting device has a reduced pressure channel which extends practically over the length of the core mandrels and which is connected to a guiding wall encompassing in an arc-shaped manner the core mandrel about at least a quarter of its circumference and to a serrated knife, in order to bring the front end of the web, which is formed on actuation of the cutting means, under the effect of an arc-shaped airstream extending at least around a quarter of the core mandrel circumference at least approximately over the width of the core mandrel and up to the vicinity of the contact line between the winding roller and the bearing core mandrel, into winding contact with the core mandrel.

Preferably the winding roller (21) has a casing provided with a rubber coating, e.g. of steel, and openings, in order by way of a reduced pressure prevailing in the inside of the winding roller to hold a bearing web in reinforced contact and to permit a practically jerk-free winding operation.

Finally the invention relates also to the application of the new cutting method for winding practically endless webs or tapes in the course of the manufacture of a foil, e.g. by extrusion, or of the processing, e.g. by cutting apart, pressing or other processings of the webs. The description "practically endless" relates to web or tape lengths, which in relationship to the web or tape width are very large, e.g. at least greater by the factor 1000. Suitable plastic foils are such with thicknesses in the region of typically between 5 and 1000 $\mu$m of known polymers, copolymers, propypolymers, polmer mixtures with film-forming molecular weights including the usual additional substances for the foil manufacture and processing.

BRIEF DESCRIPTION OF THE DRAWINGS

The invention is described in more detail by way of the accompanying drawings. There are shown.

DETAILED DESCRIPTION OF THE PREFERRED EMBODIMENTS

Figure 1:
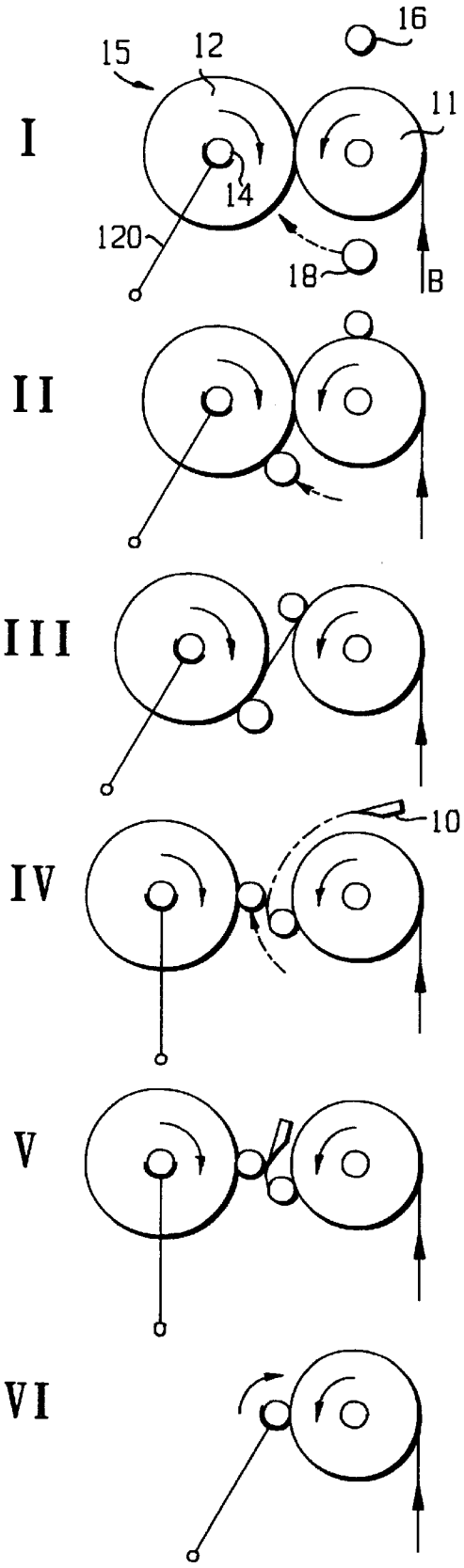
FIG. 1 a schematic representation of the course of a cutting device according to the invention.

The schematic drawing of FIG. 1 shows the cutting and winding procedure of a device 15 in five steps (I–V). It must be stressed that this subdivision serves only for the explanation and the procedure runs actually continuously. In the first step I there is shown the material web B, e.g. a paper or textile material web coming from an extruder, which runs over the winding roller 11 and which is wound onto the bearing, almost full material web winding 12 around the preceding core mandrel 14. The almost full winding 12 is held laterally on the winding roller 11 by a pivotable pair of arms 120 usually described as a "winding station" (only the front arm is shown in FIG. 1) in a desired position with the desired pressing force controlled in the desired or in the known manner (see e.g. the two previously mentioned European Patent specifications). A pivotable embodiment form of the winding station 120 is however for the present invention not critical and may be formed differently, e.g. as a carriage which can be traversed in a controlled manner with a vertical support.

An empty fresh core mandrel 16 with a guiding spike (not shown) is supplied from a magazine (not shown) of the usual construction and a deflection roller 18 is guided out of its idle position in the direction of the foil web B on the winding 12.

In the following step II the deflection roller 18 gets into contact with the foil web B on the foil winding 12 whilst simultaneously an empty core mandrel 16 with the help of a usual (not shown for an improved overview) pivoting arm pair (described as a winding station) is guided in the direction of the gap between the winding roller 11 and the foil winding 12 until the deflection roller 18 contacts the foil winding 12.

In step III the foil winding 12 by pivoting (or traversing) the winding station 120 is removed from the winding roller 11 whilst the empty core mandrel 16 and the deflection roller 18 is moved into the position which is represented in step IV of the schematic drawing of FIG. 1, i.e. the deflection roller 18 contacts the foil winding 12 and for this after finishing the contact with the winding roller 11 serves as a feed roller, and specifically preferably in a position above the contact line between the winding roller 11 and the foil winding 12, which exists before the ending of the contact. The web B runs in step IV further onto the foil winding 12, however with the diversion around the still empty core mandrel 16 and the deflection roller 18.

From now the cutting means 10 is guided in the direction of the material web B in the region between the empty core mandrel 16 and the deflection roller 18, where the material web runs freely, i.e. neither contacts the deflection roller 18 nor on the empty core mandrel 16. Between the deflection roller 18 and the empty core mandrel 16 thus there must exist a sufficient distance so that the cutting device 10 now guided to the web B may impinge and finally (step V) sever the material web B in the region of its free running between the deflection roller 18 and the still empty core mandrel, so that a "rear" end of the foil web B running out onto the foil winding 12 and a "front" end of the continuously further running foil web B envisaged for winding onto the still empty core mandrel 16 are formed.

Figure 2:
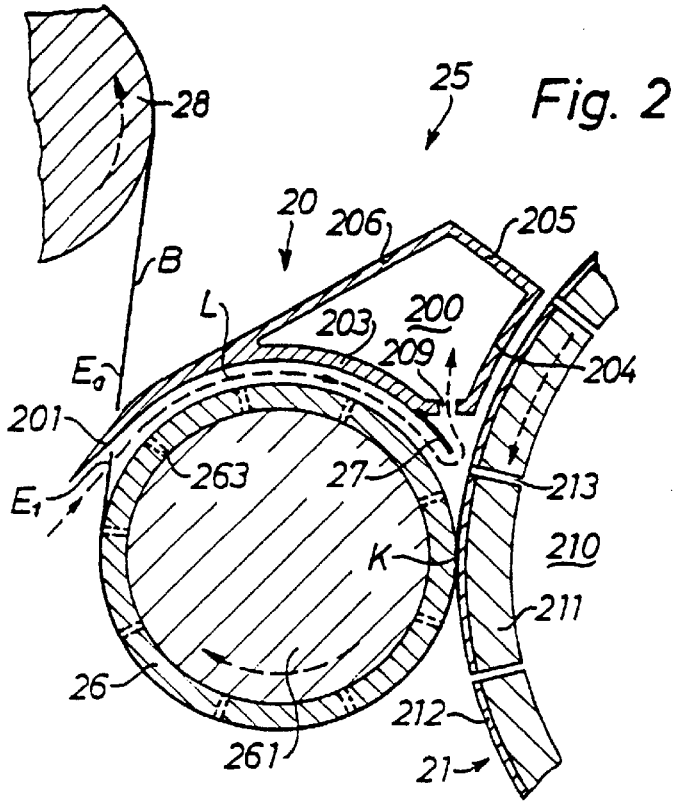
FIG. 2 a schematic part view of a cutting means according to the invention in combination with a winding device according to the invention and FIG. 3 a modification of the cutting means according to the representation in FIG. 2.
Figure 3:
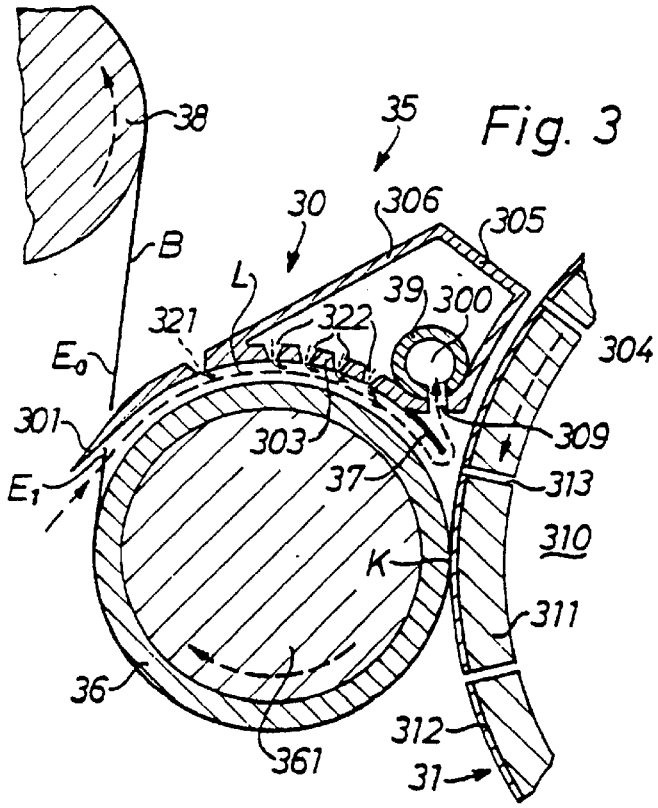

The details of the now following winding on procedure according to the present invention by way of an airstream are initially described in combination with the following FIGS. 2 and 3. In the step IV following the winding on procedure of the schematic drawing of FIG. 1 it is yet indicated how the winding station 120 after removal of the completed foil winding 12 assumes the core mandrel 16 with the foil web B which in the meantime has been wound thereon, from the (non-shown) winding station and keeps in contact with the winding roller 11 until the subsequent path separation and winding on procedure. For understanding the invention it is yet to be supplemented that the winding station as well as also preferably the winding on station for operation as a central winder is connected to a (non-shown) controllable rotational movement drive, in order to control the pulling tension acting on the web in a known manner in dependence on the material parameters, such as type, property and thickness of the web material, and on the desired linear pressure on the gap between the winding roller 11 and the bearing foil winding 12.

In any case the front end of the subsequent web section is wound onto the empty core mandrel 16 so that the (non-shown) central drive which is brought into engagement with the core mandrel 16 may exert the spool tension adapted to the winding procedure. The exact operating parameters (contact pressure on the gap between the web winding and the winding roller; pulling tension and running speed) are dependent in the known manner on the type of the winding device 15 and the web material and may by experts be optimised by way of a few less simple trials.

The essential difference between the method according to the invention and the state of the art then lies in the manner in which the winding contact required for the winding on is achieved. According to the state of the art this contact is either achieved with the help of an adhesive (e.g. in the form of an adhesive tape on the surface of the core mandrel) or by way of electrostatic charging of the foil with respect to the core mandrel. With the method according to the invention in this manner the formation of the winding contact is done away with, i.e. neither adhesive in any type of form nor an electrostatic charging is used, and the new "front" end of the material web with the help of an airstream is guided onto the core mandrel and is held on this for so long until the continued rotation of the winding roller effects a rigid clamping of the web end between the surface of the core mandrel and the following layer of the material web which is wound thereover. This new winding on method is here also described briefly as a "pneumatic winding on" and is subsequently described in detail.

In FIG. 2 schematically and by way of a cut-out a winding device 25 with a cutting means 20 according to the invention is shown, which in the manner shown in FIG. 1 is guided into the path of the material web B between the core mandrel 21 and the movable deflection roller 28. The cutting means 20 is provided with a knife 201, which in a manner not shown but in the known manner is formed as a serrated knife and extends over the whole width of the material web B. With the contact of the knife 201 with the web B this web within a very short space in time of e.g. 0.1–0.5 seconds is abruptly severed and by way of this the rear web end $E_0$ running out around the deflection roller 48 on the (non-shown) completed web winding as well as the "new" or "front" web end $E_1$ is formed. The latter is blown onto the surface of the core mandrel 26 by an arc-shaped airstream L and is held on this in winding contact.

The arc-shaped airstream L arises by way of the fact that by way of a bent conducting or guiding wall 203 extending at least over the whole width of the material web B and by way of the neighboring surface of the core mandrel an arc-shaped space is formed whose end neighboring the winding roller 21 is connected to a reduced pressure channel 200. The channel 200 may be a housing which is connected to the knife 201 and which is formed by the guiding wall 203, the wall 204 running near the winding roller 21, the rear wall 205 and the upper wall 206. The channel 200 has a slot-shaped opening 209 which extends over the channel width and which produces the airstream L. A guide plate 27 may serve for leading the path of the airstream L up to the vicinity of the winding roller 21.

The (non-shown) lateral ends of the reduced pressure channel are closed or connected to a reduced pressure source, e.g. to a container (not shown) being under pressure which is continuously evacuated with suitable powerful pumps.

The winding roller 21 according to a preferred embodiment example of the invention with the application of air-impermeable web materials as in particular plastic foils or relatively compact paper, has a hollow inner space 210 which is likewise connected to a reduced pressure source (not shown) and holds most of the material web B bearing around about 180° of the circumference of the winding roller on the surface of the winding roller 21, this surface for example consisting of a rubber layer 212 on the casing wall 211. This measure has the particular advantage of avoiding jerk-like effects on the material web in the region between the winding roller 21 and an upstream-side region of the material web which e.g. in the context of manufacture of plastic foils by extrusion or similar methods is sensitive to jerk-like loads, for example by way of an uncontrolled drawing or hanging through and tensionings in the web caused by this or by way of orientation and strength differences caused by the drawing.

In FIG. 2 the core mandrel 26 is shown guided on a solid core spike 261. It however lies within the scope of the invention to produce a reduced pressure also in the inside of the core mandrel 26, this reduced pressure acting via channels 263 shown dashed onto the bearing material web path via channels 263 and suctioning this.

FIG. 3 shows a modification of the cutting means schematically represented in FIG. 2; with this the reduced pressure channel 300 is formed by a hollow body, e.g. a tube 39 which has a slot-shaped opening 309 for suctioning the airstream L. The connection to the knife 301 may be designed in any manner, e.g. in the form of a simple connection plating or clip, as long as only the arc-shaped guiding wall 303 remains intact. If it is desired the three features of the cutting means 30 which are essential to the invention—specifically the reduced pressure channel 300, the arc-shaped guiding wall 303 and the knife 301 connected to this—may be unified with the walls 304, 305 and 306 to a hollow body which selectively is connected to the atmosphere or is under an excess pressure. In both cases with this the airstream L is supplied with additional air via the connection channels 322, this air pressing the material web B against the core mandrel 36. Also in the region of the transition of the knife 301 to the guiding wall 303 one or more openings 321 may be provided in order to produce an additionally laterally acting component of the airstream L.

Preferably the geometry, of all parts of a cutting means, which are essential to the invention, i.e. with the design of the guiding wall 203, 303, of the knife 201, 301 and of the reduced pressure channel 200, 3000, which are shown in the FIGS. 2 and 3, is formed such that the arc-shaped airstream L encompasses at least 90°, preferably at least 120° and in particular at least 140° of the circumference of the core mandrel and the material web bearing on the core mandrel up to the point in time of the web separation encompasses the core mandrel at least to 180° of its circumference.

According to a modified embodiment form (not shown) of the embodiment forms of a device according to the invention, described in the FIGS. 2 and 3, instead of a serrated knife 201, 301 a known transverse cutting device e.g. according to DE-A-2 243 504 is used which is connected to the housing 20, 30 and leads to an oblique cut. According to the invention thus also an obliquely running cut on the start of a foil section may be wound onto a fresh core mandrel without the known auxiliary means for winding on (adhesing and/or electrostatic adhesion) having to be used.

The cutting means according to the invention permits a design which is simple in comparison to the state of the art but however permits a secure operation and thus serves a row of further advantages: thus the cutting means—neglecting the knife which is mostly manufactured of steel, hard material or ceramics—may be manufactured of light metal so that the moved mass is comparatively small. With this the pivoting in and out may be effected in the usual manner with pneumatic or hydraulic actuating elements. The cutting means according to the invention may not only be installed in new installations but also existing installations for replacing the known cutting means. For the field of the man skilled in the art within the scope of the subsequent claims there results numerous modification.

What is claimed is:

1. A method of winding of a continuously moving web of material onto a sequence of core mandrels on a winding device, wherein said winding device includes a movable deflection roller, a winding roller in contact with the core mandrel along a contact line, and a cutting device, each of said core mandrels having a circumference and a width, wherein said cutting device defines an are-shaped airstream that extends around at least about one-fourth of said circumference of any of said core mandrels and extends at least approximately along said width of any of said core mandrels, said airstream extending to an area near said contact line and producing a reduced pressure area in said area near said contact line, the method comprising the steps of:

actuating said cutting device to provide a front end to said web of material;

adhering said front end of said web of material formed by actuation of said cutting device onto a first of core mandrels by said airstream; and repeating said actuation and said adhering steps for any subsequent core mandrel of said sequence.

2. The method of claim 1, wherein said airstream has a speed of at least twice that of said continuously moving web of material.

3. The method of claim 2, wherein said airstream has a speed of at least three times that of said continuously moving web of material.

4. The method of claim 3, wherein said airstream has a speed within the range of 30 to 400 meters per minute.

5. The method of claim 1, comprising the step of connecting each of said sequence of core mandrels to a central drive.

6. The method of claim 1, wherein said reduced pressure is in the region of −450 to −900 mbar.

7. The method of claim 1, wherein said airstream is supported by lateral afflux streams.

8. The method of claim 1, wherein said continuously moving web of material contacts approximately one-half of the circumference of the surface of the core mandrel when said cutting device is actuated.

9. The met hod of claim 1, wherein said winding roller includes a casing with openings and a reduced pressure inside said casing, and wherein said reduced pressure holds said web of material to prevent jerks.

10. The method of claim 1, wherein at least one of said core mandre includes openings from an outer surface into an interior which is at a reduced pressure to improve contact of the core mandrel with the web.

11. A web-cutting device for an apparatus for winding a continuous web of material onto a series of core mandrels, the device comprising:

a vacuum channel extending over the length of a core mandrel and connected to an arc-shaped guiding wall that encompasses at least one quarter of the circumference of said core mandrel; and a cutting device, wherein said guiding wall defines an arc-shaped airstream path that extends at least around one quarter of the circumference of said core mandrel, approximately across the entire width of said core mandrel and up to the vicinity of a contact line between a winding roller and said core mandrel.

12. The device of claim 11, further comprising a means for pivoting said device into a path of said web between a fresh core mandrel in contact with said winding roller and a movable deflection roller of said apparatus.

13. The device of claim 11, wherein said guiding wall includes openings from said airstream path to at least one of the atmosphere and a pressurized air source.

14. A device for continuously winding a web onto a series of core mandrels, said device comprising:

at least one movable deflecting roller; and a cutting device adapted to cut said web to form a first web end to continue onto a full core mandrel and a second web end for initiation on a subsequent empty core mandrel, wherein said cutting device comprises:

a vacuum channel that extends over the length of the core mandrel; and a guiding wall connected to said vacuum channel, wherein said guiding wall defines an arc-shaped airstream path that encompasses at least one quarter of the circumference of an empty core mandrel and extends from a serrated knife on said cutting device to the vicinity of a contact line between said empty core mandrel and a winding roller.

15. A process for taking up a continuously running web of material on a series of core mandrels of a winding device that has a winding roller, at least one movable deflection roller, and a cutting device, comprising:

forming a front end of the web by actuating the cutting device;

producing a curved airstream that extends for at least one-fourth of the core mandrel circumference and extends at least approximately over the width of the core mandrel up to a contact line between the winding roller and the core mandrel; and bringing the front end of the web by said airstream into a windingly effective contact with said core mandrel, wherein said airstream is caused by a slot-shaped opening that extends over the entire opening width and produces a reduced pressure area near said contact line.

16. The process of claim 15, wherein the speed of the airstream is at least twice the speed of the web.

17. The process of claim 16, wherein the speed of the airstream is at least three times the speed of the web.

18. The process of claim 15, wherein the speed of the web is in the range of between 30–400 meters per minute.

19. The process of claim 15, wherein said core mandrel is connected to a central drive.

20. The process of claim 15, wherein said reduced pressure is in the region of −450 to −900 mbar.

21. The process of claim 15, wherein said airstream is supported by lateral afflux streams.

22. The process of claim 15, wherein said web material contacts approximately one-half of the circumference of the surface of the core mandrel when said cutting device is actuated.

23. The process of claim 15, wherein said winding roller includes a casing with openings and a reduced pressure inside said casing, and wherein said reduced pressure holds said web of material to prevent jerks.

24. The process of claim 15, wherein said core mandrel includes openings from an outer surface into an interior which is at a reduced pressure to improve contact of the core mandrel with the web.

* * * * *